US006470618B1

(12) United States Patent
White

(10) Patent No.: US 6,470,618 B1
(45) Date of Patent: Oct. 29, 2002

(54) CARTRIDGE SHELL CASING COLLECTOR AND METHOD THEREFOR

(76) Inventor: David A. White, 9911 W. Pebble Rd., Las Vegas, NV (US) 89124

( * ) Notice: Subject to any disclaimer, the term of this patent is extended or adjusted under 35 U.S.C. 154(b) by 0 days.

(21) Appl. No.: 10/067,557

(22) Filed: Feb. 7, 2002

(51) Int. Cl.[7] ..... F41A 15/00
(52) U.S. Cl. ..... 42/90; 42/98
(58) Field of Search ..... 42/90, 98, 106; 89/1.1

(56) References Cited

U.S. PATENT DOCUMENTS 3,658,241 A * 4/1972 Pistocchi ..... 232/1 R
5,811,716 A * 9/1998 Ellzey ..... 232/44
5,934,002 A * 8/1999 Blanchet ..... 42/98

* cited by examiner

*Primary Examiner*—J. Woodrow Eldred
(74) *Attorney, Agent, or Firm*—Harry M. Weiss; Craig Weiss; Weiss, Moy & Harris, P.C.

(57) ABSTRACT

A cartridge shell casing collector and method therefor capable of allowing a user to easily collect shell casings discharged from a gun without having to bend over or come into direct physical contact with the discharged cartridge shell casings.

10 Claims, 1 Drawing Sheet

CARTRIDGE SHELL CASING COLLECTOR AND METHOD THEREFOR

FIELD OF THE INVENTION

This invention relates generally to collecting devices and, more specifically, to a cartridge shell casing collector and method therefor capable of allowing a user to collect shell casings discharged from a gun without coming into direct physical contact with the discharged cartridge shell casings.

BACKGROUND OF THE INVENTION

A gun cartridge is made up of a shell having a detonator at one end and a bullet at the other. Inside the shell is an explosive propellant which, when set off by the detonator, propels the bullet towards its target The detonator is designed to be set off by the firing mechanism of the gun. When this happens, the bullet is projected forward while the now empty cartridge shell casing is ejected from the gun. The empty shell casings fall to the ground where they lay until they are picked up. Many people, known as "reloaders", choose to recycle the empty shell casings by collecting them and inserting a detonator, filling them with gun powder and securing a bullet to the end opposite the detonator. Other people simply pick up the discharged shell casings in order to throw them away. Whatever the reason, those that fire guns often are forced to come into direct physical contact with discharged shell casings.

This presents several problems. Discharged shell casings are often hot to the touch, and can burn one's hands. Additionally, discharged shell casings often retain lead oxide residue and other propellant residues which are both a health and safety hazard. The Occupational Safety & Health Administration (OSHA), in the U.S. Department of Labor, advises people not to handle fired brass shells with one's bear hands. In addition lo the other health hazards, simply bending over repeatedly to pick up scattered shell casings puts strain on one's back and knees.

A need therefore existed for a cartridge shell casing collector and method therefor capable of allowing a user to easily collect shell casings discharged from a gun without coming into direct physical contact with the discharged cartridge shell casings.

SUMMARY OF THE INVENTION

An object of the present invention is to provide a method for collecting cartridge shell casings that allows a user to easily collect discharged cartridge shell casings without having to substantially bend over or come into direct physical contact with the discharged shell casing.

It is a further object of the present invention to provide a cartridge shell casing collector capable of allowing a user to easily pick up discharged shell casings without having to bend over or come into direct physical contact with the shell casings.

BRIEF DESCRIPTION OF THE PREFERRED EMBODIMENTS

In accordance with one embodiment of the present invention, a method for collecting cartridge shell casings is disclosed, comprising, in combination, the steps of providing a receptacle having an open end dimensioned to receive discharged shell casings from a gun, providing a substantially L-shaped member having a handle end and a receptacle coupling end, the receptacle coupling end is coupled to the receptacle, providing a flap coupled to the open end of the receptacle, providing a flap activating mechanism having a triggering end and a flap coupling end, the triggering end is coupled proximate the handle end of the substantially L-shaped member and the flap coupling end of the flap activating mechanism is coupled to the flap, the triggering end is dimensioned to trigger the flap to close and open relative to the open end of the receptacle, triggering the triggering end of the flap activating mechanism to open the flap relative to the open end of the receptacle, positioning the open end of the receptacle between a shell casing and the flap, and triggering the triggering end of the flap activating mechanism to close the flap relative to the open end of the receptacle causing the flap to drive the shell casing into the receptacle.

In accordance with another embodiment of the present invention, a cartridge shell casing collector is disclosed, comprising, in combination, a receptacle having an open end dimensioned to receive shell casings discharged from a gun, a substantially L-shaped member having a handle end and a receptacle coupling end, the receptacle coupling end is coupled to the receptacle, a flap coupled to the open end of the receptacle, and a flap activating mechanism having a triggering end and a flap coupling end the triggering end is coupled proximate the handle end of the substantially L-shaped member and the flap coupling end of the flap activating mechanism is coupled to the flap, the triggering end is dimensioned to trigger the flap to close and open relative to the open end or the receptacle.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
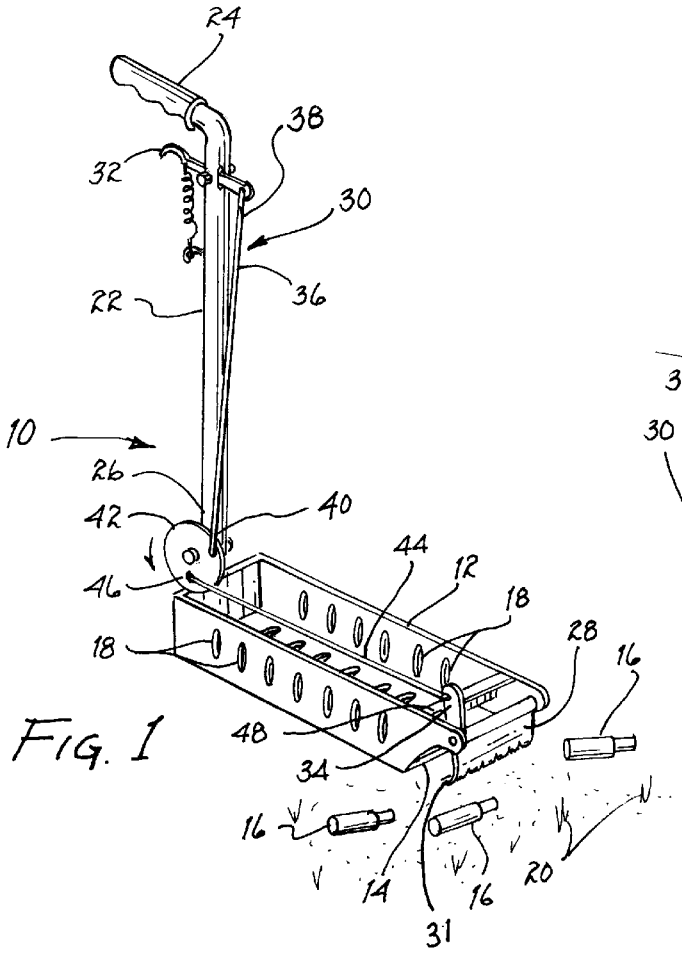
FIG. 1 is a perspective view of the cartridge shell casing collector of the present invention.
Figure 2:
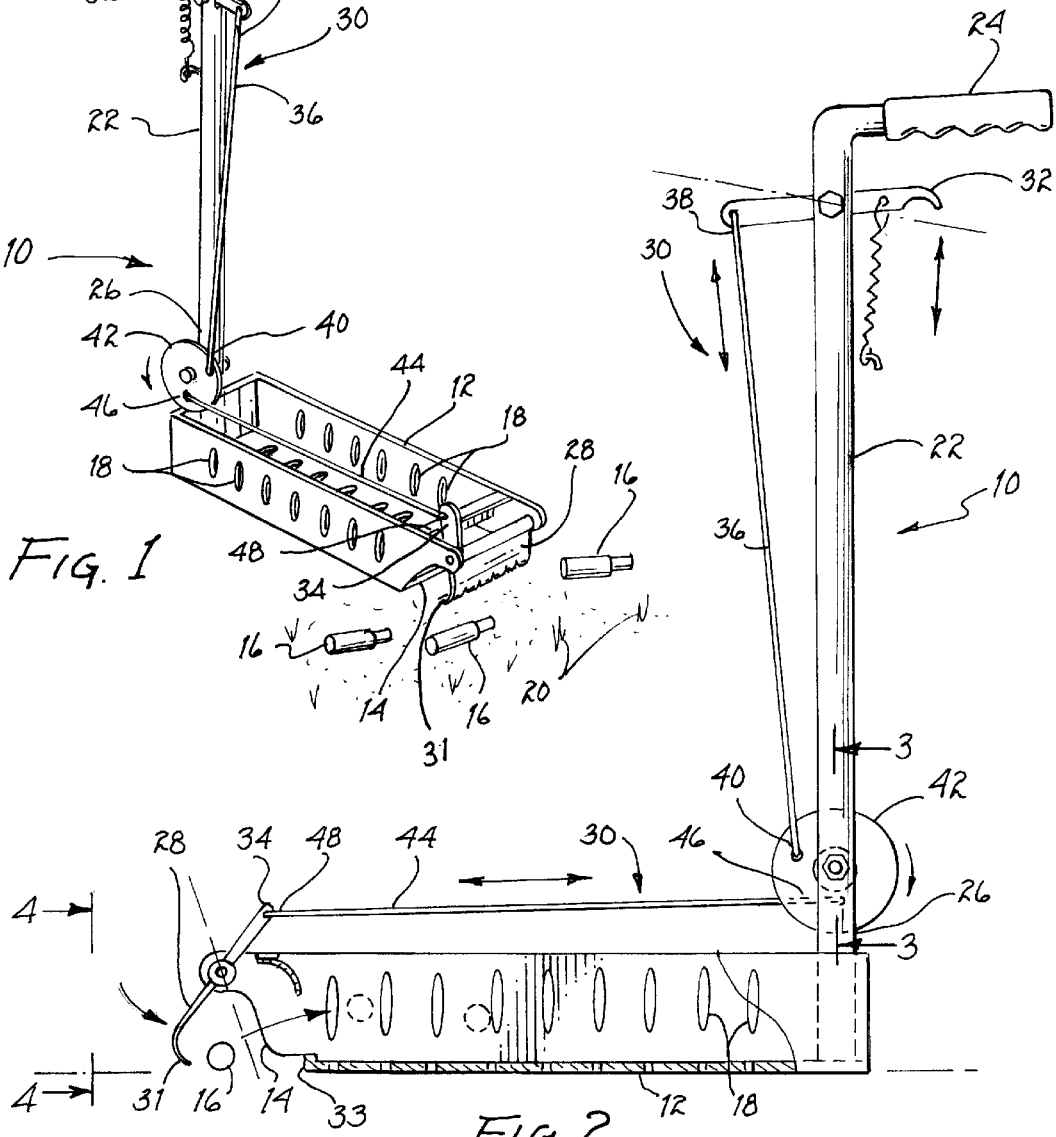
FIG. 2 is a side view of the cartridge shell casing collector of FIG. 1.

Referring to FIGS. 1–2, the cartridge shell casing collector, hereinafter cartridge shell casing collector 10, or the present invention, is shown. The cartridge shell casing collector 10 comprises a receptacle 12 having an open end 14 dimensioned to receive shell casings 16 discharged from a gun (not shown).

An the preferred embodiment, the receptacle 12 defines a plurality of apertures 18 dimensioned to allow debris 20 (shown in FIG. 1) that may have been inadvertently collected with the shell casings 16 to pass through the apertures 18 and out of the receptacle 12 while at the same time the apertures 18 are small enough to prevent the shell casings 16 from passing through the apertures in and out of the receptacle 12. While, in the preferred embodiment, the receptacle 12 defines a plurality of apertures 18, it should be clearly understood that substantial benefit could be derived from an alternative configuration of the cartridge shell casing collector 10 in which the receptacle does not define any apertures 18.

Figure 4:
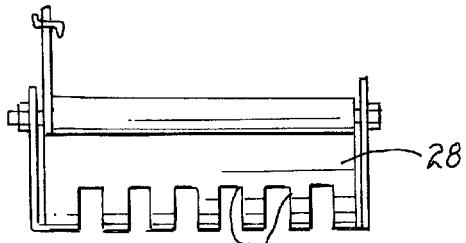
FIG. 4 is a front view of the flap of the flap activating mechanism of the cartridge shell casing collector of FIG. 2, taken along line 4—4.

Still referring to FIGS. 1–2, the cartridge shell casing collector 10 further comprises a substantially L-shaped member 22 having a handle end 24 and a receptacle coupling end 26. The receptacle coupling end 26 is coupled to the receptacle 12. The cartridge shell casing collector 10 further comprises a flap 29 (shown in FIGS. 1–2, and 4) coupled to the open end 14 of the receptacle 12 Preferably, the flap 28 defines a plurality of notches 29 (shown in FIG. 4) dimensioned to allow debris 20 to pass through the notches 29 while at the same time the notches 29 are small enough to prevent the shell casings 16 from passing through the notches 29 of the flap 28. While, in the preferred embodiment, the flap 28 defines a plurality of notches 29, it should be clearly understood that substantial benefit could be derived from an alternative configuration of the cartridge shell casing collector 10 in which the flap 28 does not define any notches 29.

In the preferred embodiment, the flap 28 has a curved bottom end 31 dimensioned to mate with a corresponding recessed bottom portion 33 (shown in FIG. 2) defined by the open end 14 of the receptacle 12, although it should be clear that substantial benefit could be derived from an alternative configuration of the cartridge shell casing collector 10 in which the flap 28 has no curved bottom end 31 and the open end 14 of the receptacle 12 does not define a recessed bottom portion 33, so long as the flap 28 is capable of securely mating with the open end 14 of the receptacle 12 so as to prevent shell casings 16 from falling out of the receptacle 12 after the shell casings 16 have been collected.

The cartridge shell casing collector 10 further comprises a flap activating mechanism 30 having a triggering end 32 and a flap coupling end 34. The triggering end 32 is coupled proximate the handle end 24 of the substantially L-shaped member 22. The flap coupling end 34 of the flap activating mechanism 30 is coupled to the flap 28. The triggering end 32 is dimensioned to trigger the flap 28 to close and open relative to the open end 14 of the receptacle 12.

Figure 3:
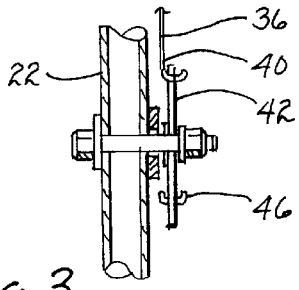
FIG. 3 is a back, cross-sectional view of the substantially L-shaped member coupled to the wheel of the flap activating mechanism of the cartridge shell casing collector of FIG. 2, taken along line 3—3.

In the preferred embodiment, the flap activating mechanism 30 preferably comprises a substantially vertical rod 36 having a first end 38 and a second end 40. The first end 38 is coupled to the triggering end 32 of the flap activating mechanism 30. The flap activating mechanism 30 preferably comprises a wheel 42 (shown in FIGS. 1–3) having a center portion coupled to the substantially L-shaped member 22 proximate the receptacle coupling end 26. The second end 40 of the substantially vertical rod 36 is preferably coupled to an outer area of the wheel 42 The flap activating mechanism 30 preferably comprises a substantially horizontal rod 44 having a first end 46 and a second end 48. The first end 46 of the substantially horizontal rod 44 is coupled to an outer area of the wheel 42 The second end 48 of the substantially horizontal rod 44 is coupled to the flap 28. While, in the preferred embodiment, the flap activating mechanism 30 comprises a substantially vertical rod 36, a wheel 42 and a substantially horizontal rod 44, it should be clearly understood that substantial benefit could be derived from an alternative configuration of the cartridge shell casing collector 10 in which the flap activating mechanism 30 comprises an alternative means for triggering the flap 28 to close and open relative to the open end 14 of the receptacle 12.

STATEMENT OF OPERATION

When a user of the cartridge shell casing collector 10 wishes to collect a shall casing 16, the user should first position the open end 14 of the receptacle 12 between the shell casing 16 and the flap 28. Then, the user should trigger the triggering end 32 of the flap activating mechanism 30 to close the flap 28 relative to the open end 14 of the receptacle 12, causing the flap 28 to drive the shell casing 16 into the receptacle 12. This method should be repeated until all shell casings 15 have been collected.

While the invention has been particularly shown and described with reference to preferred embodiments thereof, it will be understood by those skilled in the art that the foregoing and other changes in form and details may be made therein without departing from the spirit and scope of the invention.

I claim:

1. A method for collecting cartridge shell casings comprising, in combination, the steps of:

providing a receptacle having an open end dimensioned to receive discharged shell casings from a gun;

providing a substantially L-shaped member having a handle end and a receptacle coupling end, said receptacle coupling end is coupled to said receptacle;

providing a flap coupled to said open end of said receptacle;

providing a flap activating mechanism having a triggering end and a flap coupling end, said triggering end is coupled proximate said handle end of said substantially L-shaped member and said flap coupling end of said flap activating mechanism is coupled to said flap, said triggering end is dimensioned to trigger said flap to close and open relative to said open end or said receptacle;

triggering said triggering end of said flap activating mechanism to open said flap relative to said open end of said receptacle;

positioning said open end of said receptacle between a shell casing and said flap; and triggering said triggering end of said flap activating mechanism to close said flap relative to said open end of said receptacle causing said flap to drive said shell casing into said receptacle.

2. The method of claim 1 wherein said receptacle defines a plurality of apertures dimensioned to allow debris to pass through said apertures and out of said receptacle while at the same time said apertures are small enough to prevent said shell casings from passing through said apertures and out of said receptacle.

3. The method of claim 1 wherein said flap defines a plurality of notches dimensioned to allow debris to pass through said notches while at the same time said notches are small enough to prevent said shell casings from passing through said notches of said flap.

4. The method of claim 1 wherein said flap activating mechanism comprises:

a substantially vertical rod having a first end and a second end, said first end of said substantially vertical rod is coupled to said triggering end of said flap activating mechanism;

a wheel having a center portion coupled to said substantially L-shaped member proximate said receptacle coupling end, said second end of said substantially vertical rod is coupled to an outer area of said wheel; and a substantially horizontal rod having a first end and a second end; said first end of said substantially horizontal rod is coupled to an outer area of said wheel and said second end of said substantially horizontal rod is coupled to said flap.

5. The method of claim 1 wherein said flap has a curved bottom end dimensioned to mate with a corresponding recessed bottom portion defined by said open end of said receptacle.

6. A cartridge shell casing collector comprising, in combination:

a receptacle having an open end dimensioned to receive shell casing s discharged from a gun;

a substantially L-shaped member having a handle end and a receptacle coupling end, said receptacle coupling end is coupled to said receptacle;

a flap coupled to said open end of said receptacle; and a flap activating mechanism having a triggering end and a flap coupling end, said triggering end is coupled proximate said handle end of said substantially L-shaped member and said flap coupling end of said flap activating mechanism is coupled to said flap, said triggering end is dimensioned to trigger said flap to close and open relative to said open end of said receptacle.

7. The cartridge shell casing collector of claim 6 wherein said receptacle defines a plurality of apertures dimensioned to allow debris to pass through said apertures and out of said receptacle while at the same time said apertures are small enough to prevent said shell casings from passing through said apertures and out of said receptacle.

8. The cartridge shell casing collector of claim 6 wherein said flap defines a plurality of notches dimensioned to allow debris to pass through said notches while at the same time said notches are small enough to prevent said shell casings from passing through said notches of said flap.

9. The cartridge shell casing collector of claim 6 wherein said flap activating mechanism comprises:

a substantially vertical rod having a first end and a second end, said first end of said substantially vertical rod is coupled to said triggering end of said flap activating mechanism;

a wheel having a center portion coupled to said substantially L-shaped member proximate said receptacle coupling end, said second end of said substantially vertical rod is coupled to an outer area of said wheel; and a substantially horizontal rod having a first end and a second end; said first end of said substantially horizontal rod is coupled to an outer area of said wheel and said second end of said substantially horizontal rod is coupled to said flap.

10. The cartridge shell casing collector of claim 6 wherein said flap has a curved bottom end dimensioned to mate with a corresponding recessed bottom portion defined by said open end of said receptacle.

* * * * *